US008590191B2

(12) United States Patent
Waltersdorf

(10) Patent No.: US 8,590,191 B2
(45) Date of Patent: Nov. 26, 2013

(54) WRISTBAND WITH ADHERED TAGS

(75) Inventor: Bryan M. Waltersdorf, Oconomowoc, WI (US)

(73) Assignee: Artemax, Inc., Brookfield, WI (US)

( * ) Notice: Subject to any disclaimer, the term of this patent is extended or adjusted under 35 U.S.C. 154(b) by 210 days.

(21) Appl. No.: 12/848,358

(22) Filed: Aug. 2, 2010

(65) Prior Publication Data

US 2012/0023796 A1 Feb. 2, 2012

(51) Int. Cl.
*A44C 5/00* (2006.01)

(52) U.S. Cl.
USPC ..... 40/633; 283/75

(58) Field of Classification Search
USPC ..... 40/633, 6; 283/75
See application file for complete search history.

(56) References Cited

U.S. PATENT DOCUMENTS

| | | | | |
|---|---|---|---|---|
| 5,357,702 | A * | 10/1994 | Van Tuil et al. | 40/630 |
| 5,448,846 | A * | 9/1995 | Peterson et al. | 40/633 |
| 5,979,941 | A * | 11/1999 | Mosher et al. | 283/67 |
| 7,047,682 | B2 | 5/2006 | Riley | |
| 7,454,855 | B2 | 11/2008 | Kotik et al. | |
| 7,481,370 | B2 * | 1/2009 | Davis et al. | 235/462.01 |
| 7,654,024 | B2 | 2/2010 | Riley | |
| 2005/0076549 | A1 * | 4/2005 | Sellars | 40/310 |
| 2005/0091896 | A1 * | 5/2005 | Kotik et al. | 40/633 |
| 2006/0168861 | A1 * | 8/2006 | Riley | 40/633 |
| 2007/0028495 | A1 * | 2/2007 | Kotik et al. | 40/633 |
| 2009/0159714 | A1 * | 6/2009 | Coyne et al. | 235/494 |
| 2009/0205234 | A1 | 8/2009 | Hammerslag | |
| 2010/0281724 | A1 * | 11/2010 | Greer et al. | 40/633 |

* cited by examiner

*Primary Examiner* — Kristina Junge
(74) *Attorney, Agent, or Firm* — Michael Best & Friedrich LLP

(57) ABSTRACT

A wristband assembly comprising a wristband strap, a permanent adhesive supported by a first portion of the strap and adapted to secure the strap into a loop, and a temporary adhesive supported by a second portion of the strap. The wristband assembly can further include a liner positioned over the permanent adhesive, and preferably also over the temporary adhesive. The wristband assembly can also include a perforation between the second portion of the strap and the first portion of the strap to facilitate removal of the second portion. In this way, the second portion can act as a redeemable tag. After the tag has been removed and redeemed, the promoter can stick the tag to a tally sheet to organize the tags into groups of a defined number. The tally sheets can then be counted to determine the number of redeemed tags, without the need to count each tag.

19 Claims, 2 Drawing Sheets

WRISTBAND WITH ADHERED TAGS

BACKGROUND

The present invention generally relates to wristbands, and specifically to wristbands that have removable tags.

Wristbands are commonly used as a means for identifying an individual. For example, wristbands can be used to identify individuals that are authorized to be in a certain location (e.g., at a concert or a park) or to consume certain food or beverages (e.g., at a party), such as alcoholic beverages. Wristbands are commonly of a certain color or imprinted pattern to facilitate visual identification at a distance.

Wristbands can also include removable portion, commonly called "tags," that the wearer can redeem for a variety of products and activities. For example, tags can be redeemed for products, such as food and beverages, or for admission to a ride or other activity. Tags are typically made of the same material as the wristband, and are separated from the wristband by a weakened zone (e.g., scoring or perforating) to facilitate removal of the tab from the wristband.

In order for the promoter of the event to determine how many products were given away or how many admissions occurred, the tags can be counted. However, with a large event, counting the redeemed tags can be burdensome.

SUMMARY

On some wristbands, the tags extend from the end of the wristband and overlap onto the wristband material. With these wristbands, the tags can flop around and be an annoyance to the wearer. The present invention addresses this problem by adhering the tags to the wristband, thereby holding the tags down onto the surface of the wristband. More specifically, the present invention provides a wristband assembly comprising a wristband strap, a permanent securing mechanism (e.g., a permanent adhesive) supported by a first (e.g., main) portion of the strap and adapted to secure the strap into a loop, and a temporary securing mechanism (e.g., a temporary/releasable adhesive) supported by a second portion of the strap (e.g., between the permanent adhesive and a nearest end of the wristband strap) and adapted to hold the second portion of the strap in temporary engagement with another portion of the strap. The wristband assembly can further include a liner positioned over the permanent adhesive, and preferably also over the temporary adhesive.

The wristband assembly can also include a zone of weakness (e.g., a perforation or score) between the second portion of the strap and the first portion of the strap to facilitate removal of the second portion from the first portion. In this way, the second portion of the strap acts as a redeemable tag. Preferably, there is a plurality of redeemable tags connected is series from the end of the first portion of the strap and each separated from the others by a zone of weakness.

After the tag has been removed and redeemed, the promoter can stick the tag to a tally sheet that will organize the tags into groups of a defined number. In this regard, the present invention also provides a method of creating a tally sheet. The method includes providing a wristband assembly having a main portion and a tag, connecting the wristband assembly to a user, detaching the tag from the main portion (e.g., by tearing along a perforation), and attaching (e.g., adhering) the tag to a tally sheet. The tally sheets can then be counted to easily determine the number of redeemed tags, without the need to count each tag.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
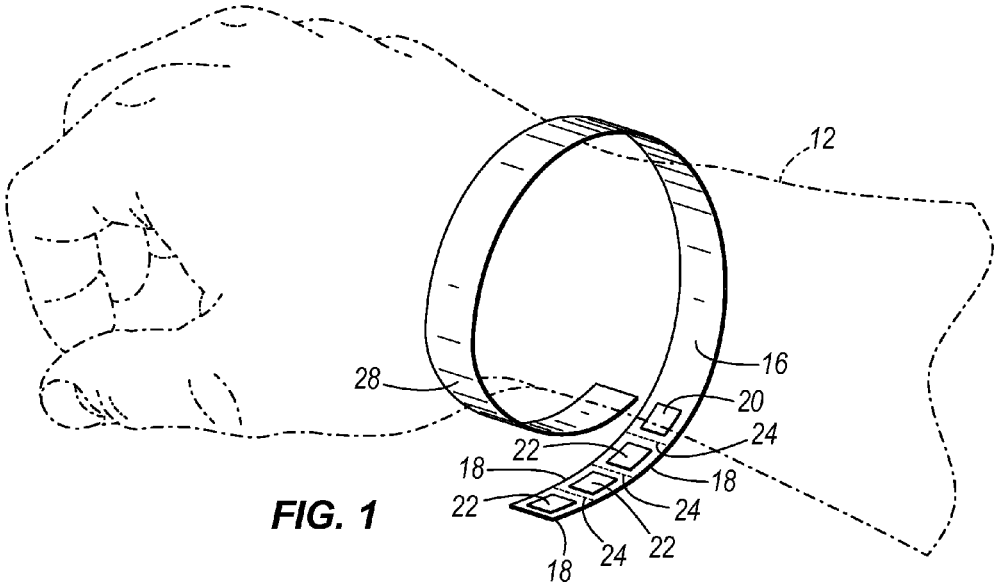
FIG. 1 is a perspective view of a wristband assembly embodying the present invention.
Figure 2:
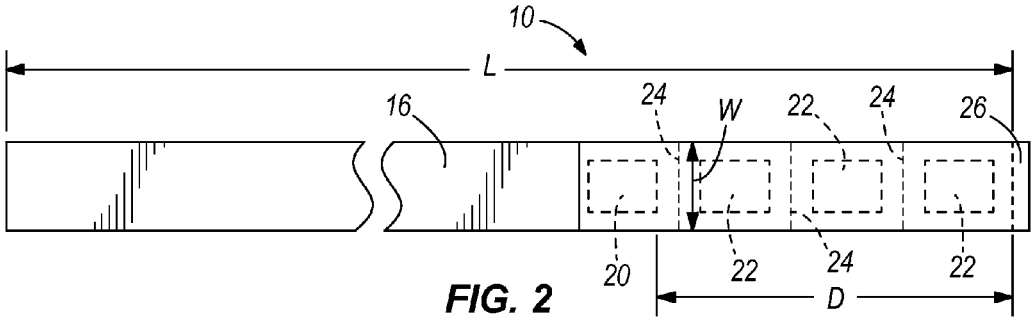
FIG. 2 is a plan view of the wristband assembly of FIG. 1.
Figure 3:
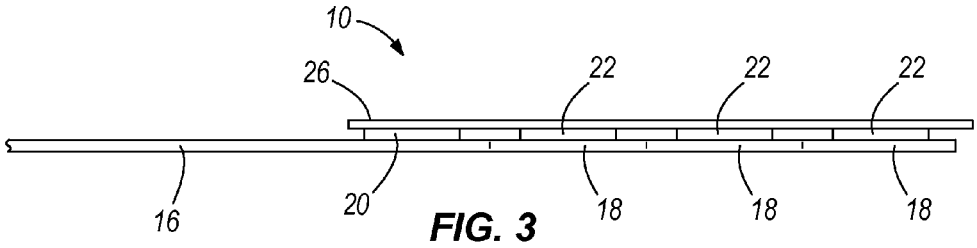
FIG. 3 is a side view of the wristband assembly of FIG. 2.
Figure 4:
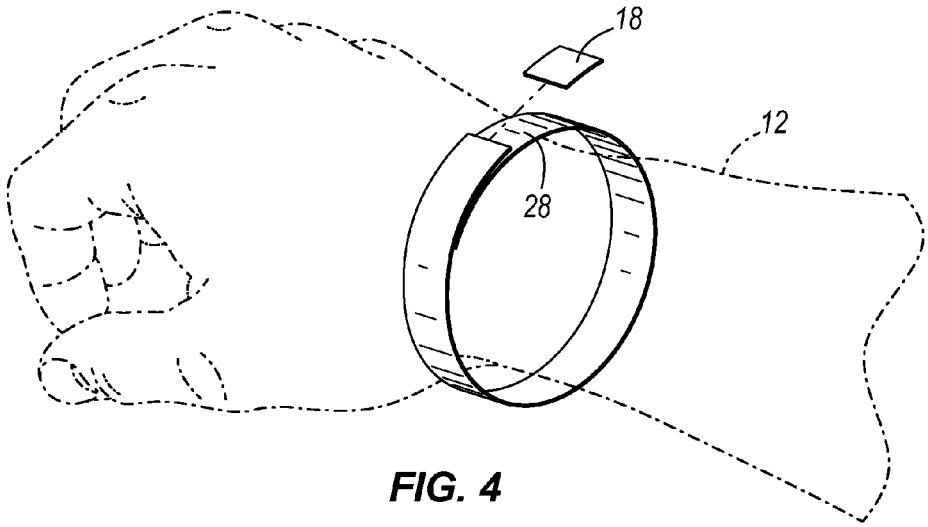
FIG. 4 is a perspective view of the wristband assembly of FIG. 1 formed into a loop on a user's wrist and with a tab being removed.

FIG. 1 illustrates a wristband assembly 10 adapted to be formed into a loop and secured to a user 12 (e.g., the user's wrist or ankle). The wristband assembly 10 includes a wristband strap having a main portion 16 and a series of detachable tags 18 attached in series to an end of the main portion 16. A permanent securing mechanism is used to securely hold the main portion 16 into a loop, and a temporary securing mechanism is positioned on each of the tags 18.

The wristband strap is made from a flexible material that preferably has a low stretch characteristic so that the strap cannot be easily removed from a user's wrist after being secured in place. The illustrated wristband strap is made from a spun plastic material, such as 0.007 inch thick Tyvek spun bonded olefin (Tyvek is a trademark of E. I. DuPont). It should be understood that other materials could be used for the wristband strap, such as molded or extruded plastic, paper, or any other suitable material.

The permanent securing mechanism makes separation of the two parts very difficult without causing damage to the main portion 16 or the permanent securing mechanism. In the illustrated embodiment, the permanent securing mechanism is in the form of permanent adhesive 20 positioned on the main portion 16 of the strap. The permanent adhesive 20 will stick to a surface of the strap when the strap is formed into a loop. The term "permanent adhesive" is used in the art to describe an adhesive that will securely hold two parts together, and makes separation of the two parts very difficult without causing damage to at least one of the two parts. The illustrated permanent adhesive 20 can be any suitable adhesive, such as a modified acrylic composition, a rubber-based adhesive, or the like. Specifically, the permanent adhesive 20 used in the illustrated embodiment is supplied as a double-coated tape, with a permanent adhesive on both sides. In other embodiments, the permanent securing mechanism could comprise other securing mechanisms, such as one-way zip ties or snaps.

The permanent adhesive 20 is spaced from the end of the strap by a distance D that is greater than the collective lengths of the tags 18. In one embodiment, the distance D of the permanent adhesive 20 from the end of the strap is 60 mm, and the total length L of the strap is about 300 mm. Thus, in this embodiment, the distance D is about 20% of the total length L of the strap. In addition, the distance D is greater than the width W of the strap.

Each of the illustrated tags 18 is made of the same material as the main portion 16 of the wristband strap, and thus the tags 18 and the main portion 16 are processed from the same sheet of material. A weakened zone in the form of a perforation line 24 defines the boundary between the main portion 16 and the first tag 18, and additional perforation lines 24 define the boundary between each of the adjacent tags 18. It should be understood that, while the illustrated embodiment shows three tags 18, a larger or smaller number of tags 18 could be provided without departing from the present invention. In addition, while the illustrated embodiment shows the strap made from a single sheet of material, it should be understood that the tags 18 and main portion 16 could be made from separate materials and subsequently attached together.

The temporary securing mechanism can be stuck to another surface and subsequently removed from the surface without significantly damaging the tag 18 or the surface on which it was adhered. The illustrated temporary securing mechanism is in the form of a temporary adhesive 22 (commonly called a "releasable," "repositionable," or "removable" adhesive) is positioned on the surface of the tag 18 between the permanent adhesive 20 and the nearest end of the strap. While the illustrated embodiment shows a separate and distinct patch of temporary adhesive 22 on each tag 18, it should be understood that the patches of temporary adhesive 22 could be connected to each other. In addition, while the illustrated patches of adhesive are spaced from the side edges of the strap, it should be understood that the adhesive could cover the entire surface area of the tags. The temporary adhesive 22 is securely fixed to each tag 18 and is not easily removable from the tag 18. The term "temporary adhesive" is used to describe the fact that each tag 18 (and its corresponding temporary adhesive 22) can be stuck to another surface and subsequently removed from the surface without damaging the tag 18 or the surface on which it was adhered. This is like the function of the popular Post-It notes (Post-It is a trademark of 3M Company, protected by U.S. Pat. No. 3,691,140, which is incorporated herein by reference in its entirety), which typically have adhesion of around 4 to 6 oz./in. to standard paper. The temporary adhesive 22 used in the illustrated embodiment is supplied as a pressure-release, double-coated tape, with a permanent adhesive on one side and a temporary adhesive on the other side. The side with the permanent adhesive faces toward and is in contact with the tag, and the side with the temporary adhesive faces away from the tag to facilitate releasable adhesion of the tag to other surfaces.

In order to prevent the permanent adhesive 20 and temporary adhesive 22 from sticking to other surfaces prior to attaching the strap to a user, the illustrated wristband assembly 10 further includes a liner 26 positioned over both the permanent adhesive 20 and the temporary adhesive 22. The illustrated liner 26 includes a 0.003 inch thick base layer made from paper covered with silicone on the surface in contact with the permanent adhesive 20 and temporary adhesive 22. The silicone layer allows the liner to be easily peeled away from the permanent adhesive 20 and temporary adhesive 22 in preparation for forming the wristband strap into a loop.

When attaching the wristband assembly 10 to a user 12, the liner 26 is first removed to expose the permanent adhesive 20 and temporary adhesive 22. The strap is then wrapped around the user 12 and formed into a loop of a size that prevents the wristband strap from sliding off of the user 12. The permanent adhesive 20 is then pressed into contact with an exterior surface 28 of the strap to thereby secure the strap into a loop. The tags 18 are then secured to the exterior surface 28 of the strap by contacting the temporary adhesive 22 with the strap. When it is desired to remove a tag 18 from the wristband assembly 10, the tag 18 closest to the end can be lifted away from contact with the strap (the temporary adhesive 22 readily releases), and the tag 18 can then be detached by tearing along the adjacent perforation line 24. The remaining tags 18 can be maintained in contact with the exterior surface 28 of the strap by the remaining temporary adhesive 22.

Figure 5:
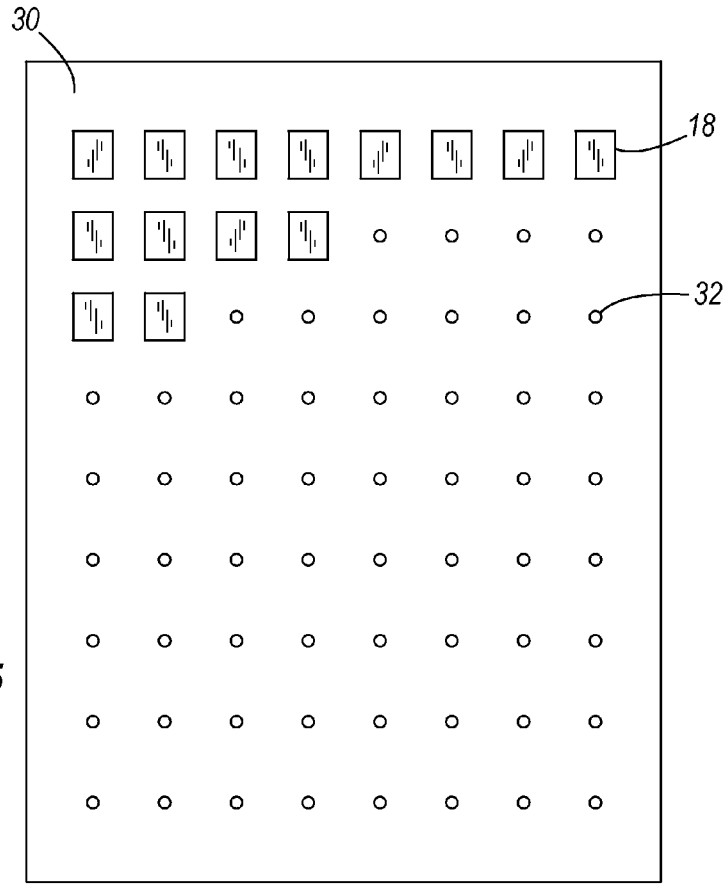
FIG. 5 is a plan view of a tally sheet with several tabs attached to a front surface of the sheet.

FIG. 5 illustrates a tally sheet 30 that can be used to store tags 18 that have been removed from wristband assemblies 10. The illustrated tally sheet 30 includes indicia 32 in the form of printed geometrical patterns that provide a visual indication of a location for attaching a tag 18. The number, shape, and positioning of the indicia 32 can vary without departing from the present invention. In use, a detached tag 18 can be placed over indicia 32 on the tally sheet 30 and adhered in place by virtue of the temporary adhesive 22 on the tag 18. If desired, the tally sheet could be provided with adhesive on its surface in order provide additional adhering force or to accommodate tags that do not have adhesive. Additional tags 18 can be adhered to the tally sheet 30 until each of the indicia 32 is covered by a tag 18. Subsequent tags 18 can be placed on the back of the illustrated tally sheet 30 and/or on additional tally sheets 30. This facilitates counting the number of redeemed tags 18 by merely counting the number of full tally sheets 30 and multiplying by the number of tags 18 on each tally sheet, thus alleviating the need to count each individual tag 18.

Various features and advantages of the invention are set forth in the following claims.

What is claimed is:

1. A wristband assembly comprising:

a wristband strap having a first portion and a second portion;

a permanent securing mechanism supported by the first portion of the strap on less than the entirety of the first portion, the permanent securing mechanism securing the first portion to itself in a loop such that the second portion forms a free end of the strap outside of the loop; and a temporary securing mechanism supported by the second portion of the strap, the temporary securing mechanism holding the second portion of the strap in temporary engagement with a surface of the first portion of the strap;

wherein the permanent securing mechanism cannot be undone without causing damage to the strap, and the temporary securing mechanism allows removal of the second portion from the first portion without causing damage to the strap.

2. The wristband assembly of claim 1, wherein the wristband strap comprises a plastic material.

3. The wristband assembly of claim 1, wherein the permanent securing mechanism comprises a permanent adhesive.

4. The wristband assembly of claim 3, wherein the temporary securing mechanism comprises a temporary adhesive.

5. The wristband assembly of claim 4, wherein a removable liner is positioned over both the permanent adhesive and the temporary adhesive.

6. The wristband assembly of claim 1, further comprising a zone of weakness between the second portion of the strap and the first portion of the strap to facilitate removal of the second portion from the first portion.

7. The wristband assembly of claim 6, wherein the assembly comprises a plurality of temporary securing mechanisms, each temporary securing mechanism being positioned on a second portion that is separated from an adjacent portion of the strap by a corresponding zone of weakness.

8. The wristband assembly of claim 1, wherein the wristband strap includes multiple second portions, each second portion includes a temporary securing mechanism.

9. The wristband assembly of claim 8, wherein each temporary securing mechanism is a pad of adhesive positioned on a corresponding second portion.

10. A method of creating a tally sheet of wristband tags, comprising:

providing a wristband assembly having a strap including a main portion and a tag;

connecting the main portion of the strap into a loop around a user with the tag forming a free end of the strap outside of the loop;

temporarily connecting the tag to the main portion;

detaching the tag from the main portion; and attaching the tag to a tally sheet.

11. The method of claim 10, wherein connecting includes:

wrapping the strap around the user;

coupling the main portion of the strap into a loop using a permanent securing mechanism; and wherein temporarily connecting the tag to the main portion includes adhering the tag to the main portion with an adhesive.

12. The method of claim 11, wherein detaching includes:

unsecuring the adhesive; and tearing the tag from the main portion.

13. The method of claim 10, wherein attaching includes adhering the tag to the tally sheet.

14. The method of claim 10, wherein the strap includes multiple tags, each tag is temporarily connected to the main portion and subsequently detached from the wristband assembly and attached to the tally sheet.

15. The method of claim 14, wherein attaching to the same tally sheet continues until a predetermined number of tags are attached to the tally sheet, and wherein, after the predetermined number of tags are attached to the tally sheet, the method further includes detaching a subsequent tag from a strap and attaching the subsequent tag to a new tally sheet.

16. A wristband assembly comprising:

a wristband strap including a main portion and a tag;

a permanent adhesive pad, supported by the main portion on less than the entirety of the main portion, securing the main portion to itself in a loop with the tag forming a free end of the strap outside of the loop;

a temporary adhesive pad, supported by the tag, holding the tag of the strap in temporary engagement with the main portion; and a removable liner positioned over both the permanent adhesive and the temporary adhesive;

wherein the permanent adhesive pad cannot be undone without causing damage to the strap, and the temporary adhesive pad allows removal of the tag from the main portion without causing damage to the strap.

17. The wristband assembly of claim 16, further comprising multiple tags, each tag detachable from the wristband strap.

18. The wristband assembly of claim 17, wherein a pad of temporary adhesive is supported on each tag.

19. The wristband assembly of claim 18, wherein the removable liner covers all the temporary adhesive pads and the permanent adhesive pad.

* * * * *